United States Patent [19]

McDowell, Jr.

[11] 4,386,877

[45] Jun. 7, 1983

[54] MINE ROOF BOLTING

[75] Inventor: Guy McDowell, Jr., Marion, Ky.

[73] Assignee: Peabody Coal Company, St. Louis, Mo.

[21] Appl. No.: 300,390

[22] Filed: Sep. 8, 1981

Related U.S. Application Data

[62] Division of Ser. No. 11,067, Mar. 28, 1979, Pat. No. 4,303,354.

[51] Int. Cl.[3] ..... E21D 21/00

[52] U.S. Cl. ..... 405/261; 405/260

[58] Field of Search ..... 405/261, 260, 259; 206/219, 220

[56] References Cited

U.S. PATENT DOCUMENTS

| | | | |
|---|---|---|---|
| 3,940,941 | 3/1976 | Libert et al. | 405/261 |
| 3,979,918 | 9/1976 | Vidler | 405/261 |
| 4,051,683 | 10/1977 | Koval | 405/261 |
| 4,179,861 | 12/1979 | Brown | 405/261 |

*Primary Examiner*—Dennis L. Taylor

*Attorney, Agent, or Firm*—Senniger, Powers, Leavitt and Roedel

[57] ABSTRACT

Mine roof bolting using an anchoring fastener comprising a bolt having a head at one end and screw-threaded at said one end, and a nut threaded on the bolt engageable with the head. On turning the nut in one direction, it moves along the bolt away from the head. On turning the nut in the other direction, it moves toward the head until it engages the head, at which point further rotation of the nut in said other direction turns the bolt in that direction. In the use of the fastener, a hole is drilled up in the mine roof, a supply of a two-component resin in the unmixed, unhardened condition is inserted in the bore, a portion of the fastener is inserted in the bore so that the headed end and the nut are outside the bore, the nut is rotated in said other direction so that it engages the head and is rotated further so that the bolt is rotated in the bore to mix the two components of the resin, the resin is allowed to harden and the nut is rotated in said one direction to move the nut into pressing relation with the mine roof.

3 Claims, 8 Drawing Figures

MINE ROOF BOLTING

This is a division of application Ser. No. 011,067, filed Mar. 28, 1979, issued as U.S. Pat. No. 4,303,354, Dec. 1, 1981.

BACKGROUND OF THE INVENTION

This invention relates to mine roof bolting, and more particularly to a method of anchoring a roof bolt within a bore in the roof by resin adhesive material.

This invention involves an improvement in the prior art method of installing anchoring means in the roof of a mine, said prior art method involving drilling a bore in the roof, inserting unmixed resin therein, partially inserting a rod into the bore, mixing the resin by rotating the rod either by rotating a nut threaded on the rod until it engages an unthreaded portion of the rod or rotating an integral head on the rod fully inserting the rod into the bore by forcing the rod up until the nut or head is in a pressing relationship with the roof, and continuing the application of the pressing force until the resin has hardened thereby securing the rod to the roof. The prior art anchoring means and the method of utilizing it provide "fully grouted" bolting satisfactory for the bonding or pegging of the roof strata together, but they do not provide "point anchored" bolting for the clamping of the roof strata together by tension developed in the anchoring means. "Point anchored" bolting is preferred over "fully grouted" bolting for certain types of roof strata.

SUMMARY OF THE INVENTION

Among the several objects of this invention may be noted the provision of a method of installing roof bolts to effect simultaneously "point anchored" and "fully grouted" bolting.

In general, the method of this invention of supporting a roof of a mine utilizes anchoring means comprising a bolt and a nut threaded on the bolt adapted for rotation of the nut to rotate the bolt to mix resin grouting material components in a bore in the roof and then for rotation of the nut to thread it up on the bolt, and comprises drilling at least one blind end bore up into the roof, and inserting two charges of resin grouting material in the bore, each charge comprising components to be mixed for providing hardened resin grouting in the bore. The first charge inserted in the bore is a relatively fast setting resin adhesive material and the second is a relatively slow setting resin adhesive material. Sufficient grouting material is provided in the bore to secure the bolt in the bore over the entire portion of the length of the bolt in the bore. The charge of fast setting resin adhesive material is at the upper end of the bore and the charge of slow setting resin adhesive material is below the fast setting charge. The bolt is inserted in the bore with the nut outside the bore, and the nut is rotated to rotate the bolt to mix together the components of the slow setting resin material and the components of the fast setting resin material. The fast setting resin adhesive material is allowed to set so as to anchor the bolt at its upper end in the bore. Then, with the bolt so anchored at its upper end in the bore and before the slow setting resin adhesive material in the bore below the fast setting resin adhesive material has set, the nut is rotated to thread the nut up on the bolt into pressure relation with the mine roof to tension the remaining portion of the bolt in the bore with resultant compression of the roof strata surrounding the bore between the nut and the upper portion of the bolt, and the slow setting resin is allowed to harden so as to anchor said remaining portion of the bolt under tension in the bore.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
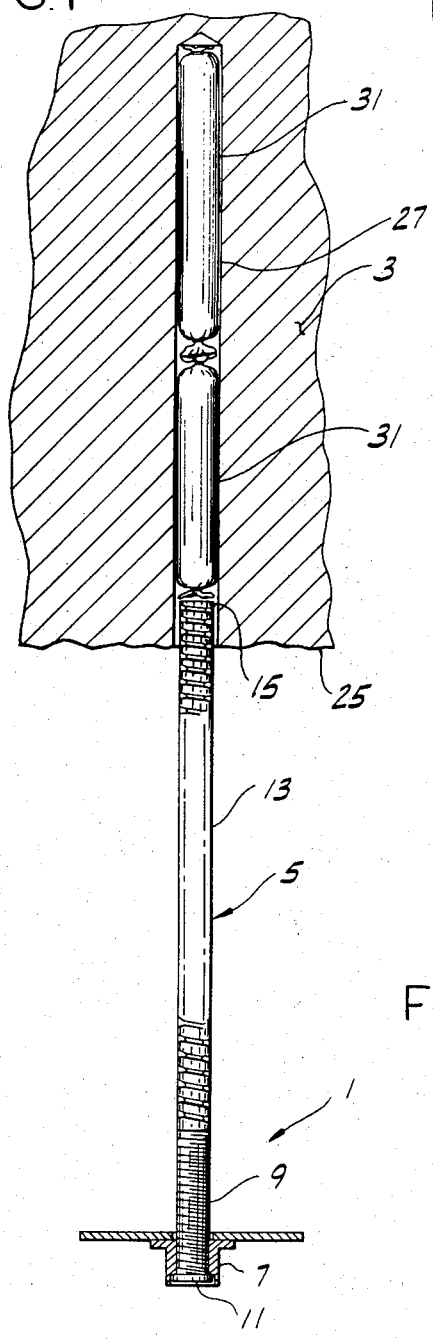
FIG. 1 is a section through a bore in the roof of a mine showing packages of resin components therein and anchoring means as initially inserted in the bore.

Referring to FIG. 1 of the drawings, an anchoring means 1 for supporting a roof 3 of a mine is shown to comprise a bolt 5 and a nut 7. The bolt 5 has a screw threaded portion 9 and an integral head 11 at a first end (its lower end as shown) and has an unthreaded portion 13 extending from the screw threads at the first end to a second end 15 which can be headless (as shown) or headed (not shown). Like conventional resin bonded bolts, the bolt 5 may be formed of metal bar stock of the type used to reinforce concrete (i.e., "rebar") having a pattern of ridges on its surface, and may have its screw threads 9 either cut or roll formed in the bar to extend one or more inches from the first (lower) end of the bar. The pattern of ridges may be of conventional configuration such as, for example, ASTM-615 "Bambo", (see the unthreaded portion 13 of bolt 5 shown in FIG. 5) or the "Dywdag" design (see the unthreaded portion 13 shown in FIG. 6).

Figure 3:
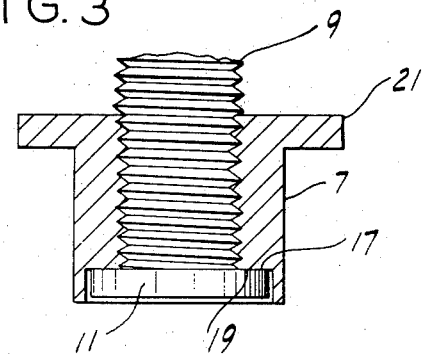
FIG. 3 is an enlarged section of the lower end of the anchoring means.

The nut 7 has an end surface 17 toward the first end of the bolt 5 engageable with the inner face 19 of the head 11 (see FIG. 3). Generally, the head 11 is formed after the nut is threaded on the screw-threaded part 9 of the bolt from its said first end. A flange 21 is provided at the other end of the nut 7 integral with the nut 7 as shown in FIG. 3 engageable at its upper face with a roof bolt plate 23 carried on the bolt 5, the plate 23 in turn being engageable at its inner face with the roof surface 25. A washer separate from the nut may be used instead of the flange 21. When the nut 7 is rotated relative to the bolt 5 in one direction it moves along the bolt toward the second (upper) end 15 thereof. When the nut 7 is rotated relative to the bolt 5 in the other direction, it moves along the bolt toward the first (lower) end thereof until its surface 17 engages surface 19 of the head 11 (see FIG. 3). At this point the nut 7 can not be rotated further relative to the bolt 5 in that direction, and the application of torque tending to rotate the nut 7 further in that direction tends to rotate the nut 7 and the bolt 5 together in that direction.

The anchoring means 1 is installed in the roof of a mine to support the roof 3 by the steps of operation generally indicated in FIGS. 1, 2, 4, 5 and 6; "point anchored", "fully grouted" and simultaneous "point anchored" and "fully grouted" bolting arrangements of the anchoring means being shown in FIGS. 4, 5 and 6, respectively. The initial step in the installation of the anchoring means 1 in the roof of the mine is the drilling of a blind-end bore 27 into the roof 3 from roof surface 25. The bore 27 should be of a slightly greater diameter and length than the diameter and length of the anchoring means 1 to be inserted therein.

Figure 8:
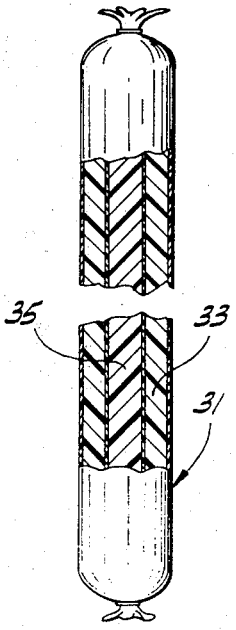
FIG. 8 is an elevation of a resin package with portions thereof shown in section.

A charge of components for providing a resin grout in the bore is inserted in the bore. The charge is typically a two-component charge, preferably comprising a polyester resin material as one component and a peroxide hardener as the other, such as the product sold under the trade name Nordbak by Rexnord Inc., Specialty Chemicals Division, Brookfield, Wis. or the product sold under the trade name Carboloy by General Electric Company, Carboloy Systems Department, Detroit, Mich. The components are packaged in a frangible plastic two-compartment package 31, resembling a sausage, the components being separately encased in the package to maintain them separate until the package is broken and the components are mixed together, whereupon the resin hardens. FIG. 1 shows two such packages or cartridges 31 inserted in the bore. FIG. 8 shows the package or cartridge as comprising a compartment holding the polyester resin component 33 and the other compartment holding the peroxide hardener component 35. The upper end of the bore 27 is indicated at 37. Generally, the bolt 5 is inserted in the bore extending all the way up to or nearly all the way up to the upper end of the bore. The charge of the resin components is sufficient in amount to provide enough resin to fill whatever space there may be at the upper end 37 of the bore above the upper end of the bolt and at least part of the annular space 39 surrounding the bolt in the bore. The resin in the said space is indicated at 29 in FIGS. 2 and 4. The resin hardens or sets in a relatively short period of time after the two components are mixed. A fast acting type of resin sets in about 40 seconds after mixing; a slow acting type sets in about 100 seconds after mixing.

Figure 2:
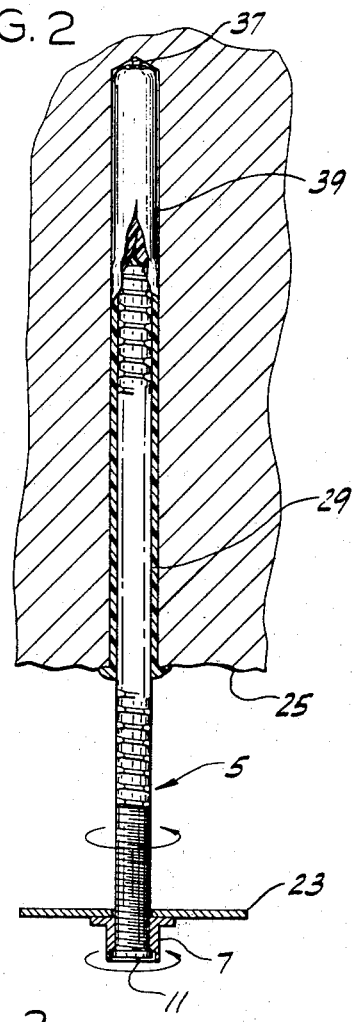
FIG. 2 is a view similar to FIG. 1 showing the anchoring means in an upwardly moved position and the packages broken open.

After inserting the packages or cartridges of the resin in the bore 27, the end 15 of the bolt 5 is inserted into the bore (see FIG. 2). The bolt 5 is pushed up toward the upper end 37 of the bore 27, breaks the frangible packages 31, and forces the resin material into the space above the upper end of the bolt and the annular space 39 around the bolt. The insertion of the bolt 5 into the bore 27 continues until the roof bolt plate 23 engages or is closely adjacent the roof surface 25. Generally, at this point end 15 of the bolt 5 will be spaced slightly from the upper end 37 of the bore 27. Close spacing minimizes the amount of resin 29 in the space above the upper end of the bolt where thorough mixing of the components 33 and 35 by rotating the bolt is difficult to achieve.

Shortly after the insertion of the bolt 5 into the bore 27 or, preferably, simultaneous with the insertion, the bolt 5 is rotated for mixing the two components of the resin. Such rotation is effected by means of the drill element of a conventional roof bolting machine (not shown), the bolt 5 being spun rapidly (i.e., at 200–250 rpm) for at least 20 seconds to thoroughly mix the components in the annular space 39. Rotating the bolt 5 as it is inserted into the bore increases the period of rotation and hence provides for more thorough mixing. The bolt is rotated by having the bolting machine engage the nut 7 and rotate the nut in the direction for moving the nut along the bolt 5 (downwardly relative to the bolt) into engagement with the head 11 of the bolt so that continued rotation of the nut 7 in that direction causes the nut and the bolt to rotate together (see FIG. 2). The pattern of ridges on the surface of the unthreaded portion 13 of the bolt 5 facilitates the thorough mixing of the components.

After the components have been thoroughly mixed, the rotation of the nut 7 is terminated and the material is allowed to harden in place in the bore 27 around the bolt 5, thereby securing the bolt to the surfaces of the roof defining the bore 27. During the hardening process, the bolting machine may be used to apply an upward force on the nut 7 and bolt 5 to press the bolt plate 23 against the roof surface 25 to fully insert the bolt 5 in the bore 27 and to effect a limited clamping or compressing of the roof strata.

After hardening of the resin 29, the direction of rotation of the drill element of the bolting machine is reversed so that rotation of the nut 7 moves the nut along the then stationary bolt 5 upwardly on the bolt away from the head 11 and toward the roof surface 25. Continued rotation of the nut 7 provides for high pressure engagement of the roof bolt plate 23 with the roof 3.

Figure 4:
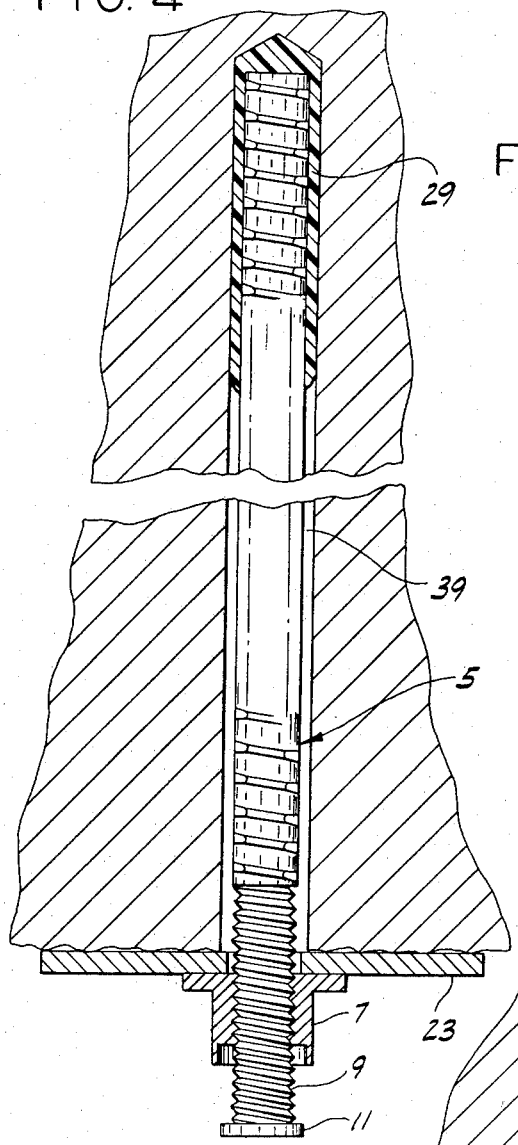
FIG. 4 is a view similar to FIG. 2 showing "point anchored" bolting of the anchoring means.

In the "point anchored" bolting method, as indicated generally in FIG. 4, only sufficient resin 29 is provided in the bore 27 to secure the bolt 5 at its end 15 and along an upper portion of its length to the surfaces of the roof 3 defining the bore 27. The bolt 5 may be three, four or more feet long, a relatively long lower portion of the length of the bolt 5 then being ungrouted in the bore. Rotating the nut 7 after the resin hardens, with the nut pressing up against the roof bolt plate 23, tensions the lower portion of the bolt 5 and effects clamping or compressing of the roof strata between the hardened resin 29 and the plate 23.

Figure 5:
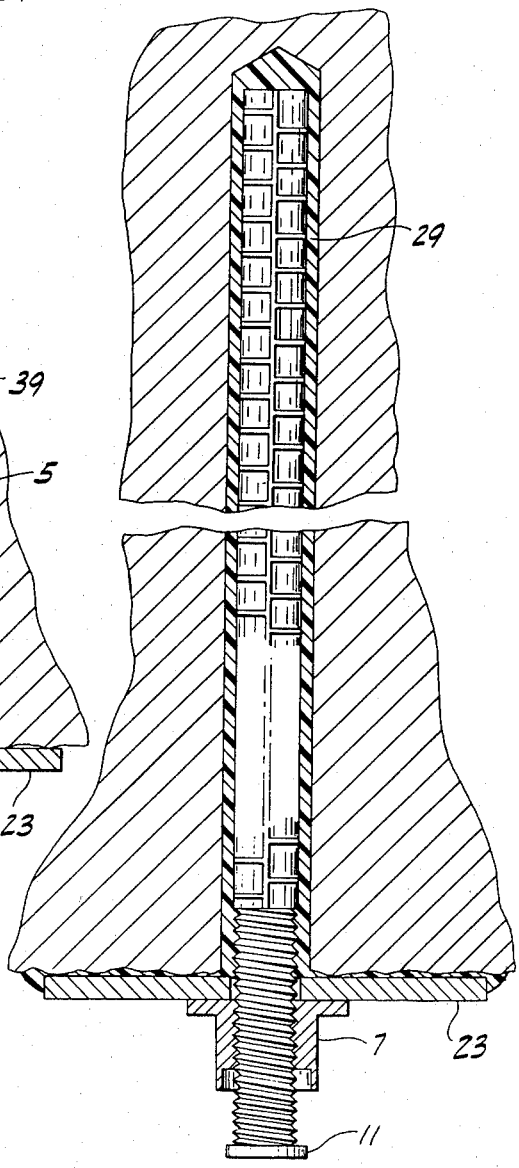
FIG. 5 is a view similar to FIG. 4 showing "fully grouted" bolting of the anchoring means.

As generally indicated in FIG. 5, the "fully grouted" bolting method involves providing a sufficient quantity of resin 29 entirely to fill the space above the upper end of the bolt and the annular space 39 along the entire length of the bolt to secure the bolt throughout its length in the bore 27. This effects bonding or pegging of the roof strata along the entire length of the bolt 5 in the bore 27. Once the resin has hardened, the nut 7 may be rotated for high pressure engagement of plate 23 with the roof surface 25 to provide a greater roof support force than is possible with the prior art "fully grouted" bolting method, in which there is no rotation of the nut after the hardening of the resin.

Figure 6:
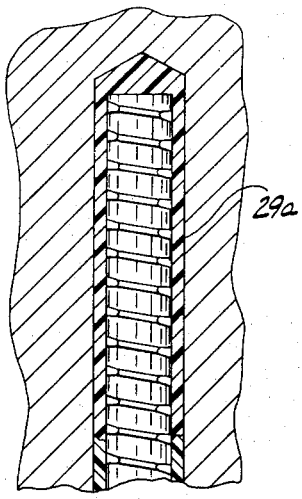
FIG. 6 is a view similar to FIG. 5 showing simultaneous "fully grouted" and "point anchored" bolting of the anchoring means.
Figure 7:
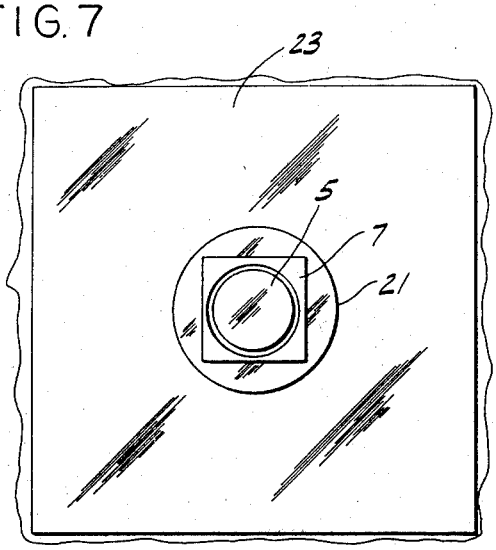
FIG. 7 is a bottom plan of the anchoring means.
Figure 7:
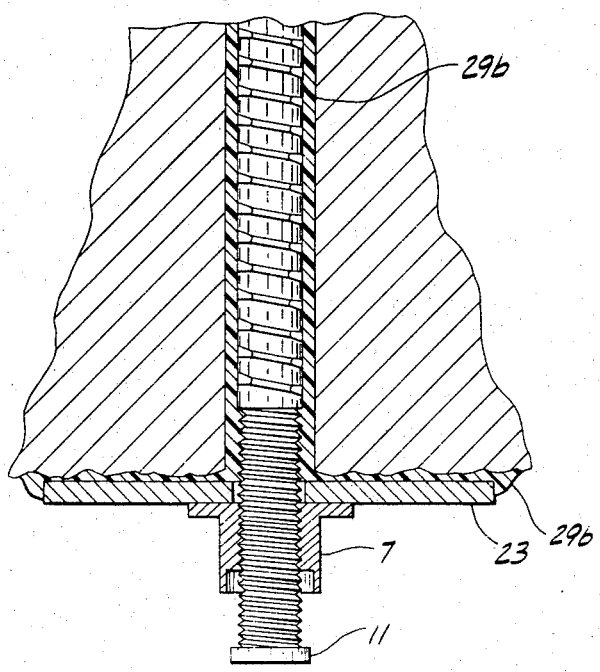

A simultaneous "point anchored" and "fully grouted" bolting method is illustrated in FIG. 6. This involves inserting a quantity of fast setting resin 29*a* and subsequently inserting a quantity of slow setting resin 29*b*. Like "fully grouted" bolting, the total quantity of resin (both fast setting and slow setting) is sufficient completely to fill the space around the bolt in the bore and, as in "point anchoring" bolting, the nut 7 may be rotated into high pressure engagement with plate 23 to develop increased tension in the lower portion of the bolt 5 for clamping the roof strata after the upper portion of the bolt is secured. This is possible because during the period of time between the hardening of the fast setting resin 29a (i.e., approximately twelve seconds after mixing) securing the upper portion of the bolt 5, and the hardening of the slow setting resin 29b securing the lower portion of the bolt 5, the nut can be rotated to drive it up on the bolt into higher pressure engagement with plate 23. Thus, the bonding or pegging benefits of "fully grouted" bolting and the clamping or compressing benefits of "point anchored" bolting can be simultaneously obtained.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. The method of supporting a roof of a mine utilizing anchoring means comprising a bolt having a head at one end and a screw thread at said one end, and a nut threaded on the screw thread on the bolt having an end surface toward the headed end of the bolt engageable with the inner face of the head, whereby when the nut is rotated relative to the bolt in one direction, the nut moves along the bolt away from said headed end thereof and when the nut is rotated relative to the bolt in the other direction, the nut moves along the bolt toward said headed end thereof until the nut engages the head, at which point the nut cannot be rotated further relative to the bolt in said other direction so that the application of any torque to rotate the nut in said other direction will tend to rotate the nut and bolt together in said other direction; said method comprising:

drilling at least one blind end bore up into the roof, inserting two charges of resin grouting material in the bore, each charge comprising components to be mixed for providing hardened resin grouting in the bore, the first charge inserted in the bore being a relatively fast setting resin adhesive material and the second being a relatively slow setting resin adhesive material, sufficient grouting material being provided in the bore to secure the bolt in the bore over the entire portion of the length of the bolt in the bore, the charge of fast setting resin adhesive material being at the upper end of the bore and the charge of slow setting resin adhesive material being below the fast setting charge, inserting the bolt in the bore with the headed end of the bolt and the nut outside the bore, rotating the nut in said other direction until the nut engages the head, continuing to rotate the nut in said other direction so as to rotate the bolt in said other direction to mix the components of the slow setting resin material together and the components of the fast setting resin material together, allowing the fast setting resin adhesive material to set so as to anchor the bolt at its upper end in the bore, then, with the bolt so anchored at its upper end in the bore and before the slow setting resin adhesive material in the bore below the fast setting resin adhesive material has set, rotating the nut in said one direction to move the nut into pressure relation with the mine roof to tension the remaining portion of the bolt in the bore with resultant compression of the roof strata surrounding the bore between the nut and the upper portion of the bolt, and allowing the slow setting resin to harden so as to anchor said remaining portion of the bolt under tension in the bore.

2. The method of claim 1, wherein each of said charges of resin adhesive material is a two-component material contained in at least one frangible two-compartment package, one compartment of the package holding one component and the other compartment holding the other component, and wherein said inserting of the bolt within the bore and said rotating of the bolt in said other direction rupture all the compartments of the packages positioned within the bore.

3. The method of supporting a roof of a mine utilizing anchoring means comprising a bolt and a nut threaded on the bolt adapted for rotation of the nut to rotate the bolt to mix resin grouting material components in a bore in the roof and then for rotation of the nut to thread it up on the bolt, said method comprising:

drilling at least one blind end bore up into the roof, inserting two charges of resin grouting material in the bore, each charge comprising components to be mixed for providing hardened resin grouting in the bore, the first charge inserted in the bore being a relatively fast setting resin adhesive material and the second being a relatively slow setting resin adhesive material, sufficient grouting material being provided in the bore to secure the bolt in the bore over the entire portion of the length of the bolt in the bore, the charge of fast setting resin adhesive material being at the upper end of the bore and the charge of slow setting resin adhesive material being below the fast setting charge, inserting the bolt in the bore with the nut outside the bore, rotating the nut to rotate the bolt to mix the components of the slow setting resin material together and the components of the fast setting resin material together, allowing the fast setting resin adhesive material to set so as to anchor the bolt at its upper end in the bore, then, with the bolt so anchored at its upper end in the bore and before the slow setting resin adhesive material in the bore below the fast setting resin adhesive material has set, rotating the nut to thread the nut up on the bolt into pressure relation with the mine roof to tension the remaining portion of the bolt in the bore with resultant compression of the roof strata surrounding the bore between the nut and the upper portion of the bolt, and allowing the slow setting resin to harden so as to anchor said remaining portion of the bolt under tension in the bore.

* * * * *